US005715759A

United States Patent [19]

Lee

[11] Patent Number: 5,715,759

[45] Date of Patent: Feb. 10, 1998

[54] APPARATUS FOR SETTING FURNITURE IN VARIABLE ELEVATED POSITIONS

[76] Inventor: Eun Ok Lee, 442-13 Sungnae-dong, Kangdong-ku, Seoul 134-030, Rep. of Korea

[21] Appl. No.: 718,348

[22] PCT Filed: Jul. 14, 1995

[86] PCT No.: PCT/US95/09741

§ 371 Date: Oct. 1, 1996

§ 102(e) Date: Oct. 1, 1996

[87] PCT Pub. No.: WO95/27420

PCT Pub. Date: Oct. 19, 1995

[30] Foreign Application Priority Data

| | | | |
|---|---|---|---|
| Apr. 6, 1994 | [KR] | Rep. of Korea | 94 7201 |
| Apr. 9, 1994 | [KR] | Rep. of Korea | 94 7406 |
| Apr. 11, 1994 | [KR] | Rep. of Korea | 94 7482 |
| Aug. 16, 1994 | [KR] | Rep. of Korea | 94 20657 |
| Aug. 16, 1994 | [KR] | Rep. of Korea | 94 20658 |

[51] Int. Cl.[6] ..... A47B 85/00

[52] U.S. Cl. ..... 108/20; 108/147

[58] Field of Search ..... 108/10, 20, 42, 108/144, 147, 148

[56] References Cited

U.S. PATENT DOCUMENTS

| | | | |
|---|---|---|---|
| 3,304,892 | 2/1967 | Bengton | 108/147 |
| 3,820,176 | 6/1974 | Feiertag | 108/147 |
| 4,619,208 | 10/1986 | Kurrasch | 108/20 |

FOREIGN PATENT DOCUMENTS

| | | |
|---|---|---|
| 3736012 | 7/1988 | Germany . |
| WO92/10120 | 6/1992 | WIPO . |

*Primary Examiner*—Peter M. Cuomo

*Assistant Examiner*—Gerald A. Anderson

*Attorney, Agent, or Firm*—Andrus,Sceales,Starke & Sawall

[57] ABSTRACT

The apparatus for setting furniture in variable elevated positions of the present invention is comprised of a rail (14) which is vertically secured onto the surface of an interior wall; elevating means (12) which vertically move upon and along said rail (14) and include a furniture supporting means and a guide means for engaging with said rail and preventing rotation of said elevating means (12); and means to effect the vertical motion of said elevating means. Said means to effect the vertical motion of said elevating means is comprised of pulley sets (22, 24, 30, 36) and a rope (32) connected to said pulleys, so if a portion of said rope (32) is pulled, said elevating means (12) is elevated, and if said rope (32) is released, said elevating means (12) is lowered.

9 Claims, 9 Drawing Sheets

APPARATUS FOR SETTING FURNITURE IN VARIABLE ELEVATED POSITIONS

BACKGROUND OF THE INVENTION

1. Field of the Invention

This invention relates to an apparatus for setting furniture in variable elevated positions, which supports furniture and provides a means through which the furniture's vertical position may be adjusted as desired.

2. Description of the Prior Art

Indoor furniture, such as desks, tables, counters, etc., take up much interior space in areas such as bedrooms, living rooms, kitchens, etc. To reduce the amount of space required for such furniture, folding or sliding furniture have been proposed. However, practical considerations make difficult the conversion of furniture into folding or sliding configurations. Further, even if furniture is designed to fold or slide, the amount of space required for such furniture is not greatly reduced.

SUMMARY OF THE INVENTION

To solve the above problems, the present invention proposes fixing the vertical position of the furniture near the floor when in use, and to elevate the vertical position of the furniture toward the ceiling when not in use. Thus, when the furniture is not being used, the available floor space is greatly increased.

Thus, the purpose of the present invention is to provide an apparatus for the fixation and variation in vertical elevation of the position of furniture, at and between a lower position at which the furniture may be used and an upper position for when the furniture is not being used.

Another purpose of the present invention is to provide an apparatus for setting furniture which has a guide means for stabilizing the furniture during the vertical movement of the furniture.

Another purpose of the present invention is to provide an apparatus for setting furniture which provides for vertical motion of the furniture by means of an electric motor.

The above purposes are accomplished by the apparatus for setting furniture in variable elevated positions of the present invention. The apparatus comprises a vertical rail secured to the interior wall surface, elevating means which includes means for securing the furniture and provides for an elevating motion along said rail, and means to drive said elevating means vertically.

According to one embodiment, the furniture setting apparatus of the present invention is comprised of a rail which is secured to the interior wall and which includes multiple fixed pulleys on the upper portions; an elevating member which includes a movable pulley and which may be moved along said rail; an outlet pulley which is secured on the outside of said rail at the same height as the fixed pulley on the upper portion of said rail; a rope which is wrapped around said outlet pulley, fixed pulley, and movable pulley, so that said movable pulley may be elevated correspondingly with said fixed pulley; where said rail has a rectangular cross-section and has grooves formed lengthwise along its front side and rear side; and where said elevating member has a guide and a roller which may be guided along and which are inserted in said rail grooves, and a supporting member which can secure the furniture at fixed positions at the front and back of the supporting member. Therefore, the user can pull or release said rope to operate the elevating means and the furniture, which is supported by the elevating means, also moves vertically.

According to another embodiment of the present invention, the fixed pulleys are replaced with pulley sets which are comprised of two unit pulleys and the movable pulley in the elevating means is comprised of three unit pulleys respectively, so that the elevating means, which is secured to the furniture, may be easily elevated with little force.

According to another embodiment of the present invention, the elevating means is provided at its rear with a guide and a roller, where said guide is mounted above the movable pulley and inserted into the groove formed between the front panels of the rail so as to guide the elevating motion of the elevating means, said roller is mounted below the movable pulley and inserted into the groove formed in the rear panel of the rail so as to prevent the rotation to the left or right of the elevating means upon vertical motion thereof.

Also, according to another embodiment of the present invention, an electric motor which provides traction for the rope and which is mounted parallel to the outlet pulley on the exterior of the rail secured on the wall is provided. Further, according to this same embodiment, a driving device, which is comprised of a drum to secure a portion of the rope, and which is mounted on the rotating shaft of the electric motor, and which rotates in both directions according to the rotation of the motor, is provided.

According to another embodiment of the present invention, the driving device has a sensing member, which is adapted to limit the vertical movement of the elevating member within defined limits, and a reduction device, which allows the control of the rotation speed of the electric motor.

PREFERRED EMBODIMENTS OF THE INVENTION

Figure 1:
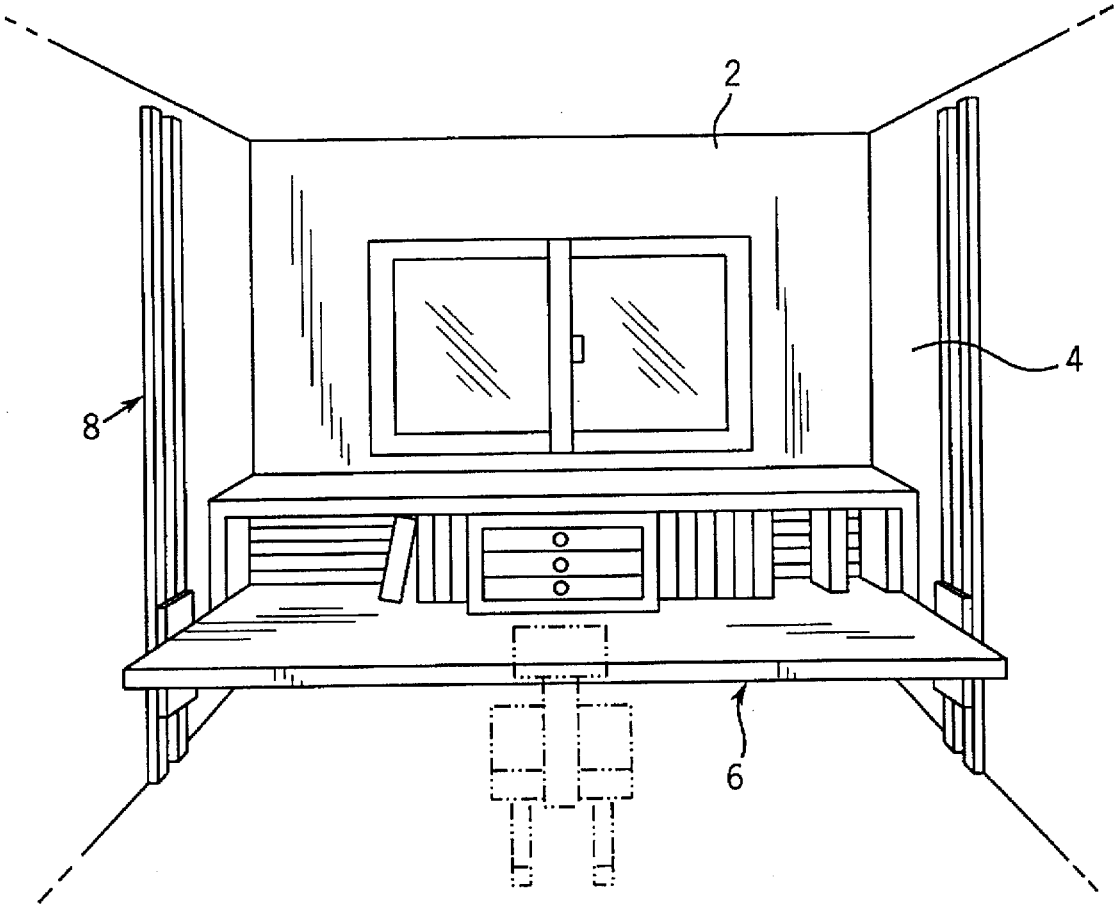
FIG. 1 is a pictorial view which shows furniture set on the setting apparatus for furniture according to one embodiment of the present invention.
Figure 2:
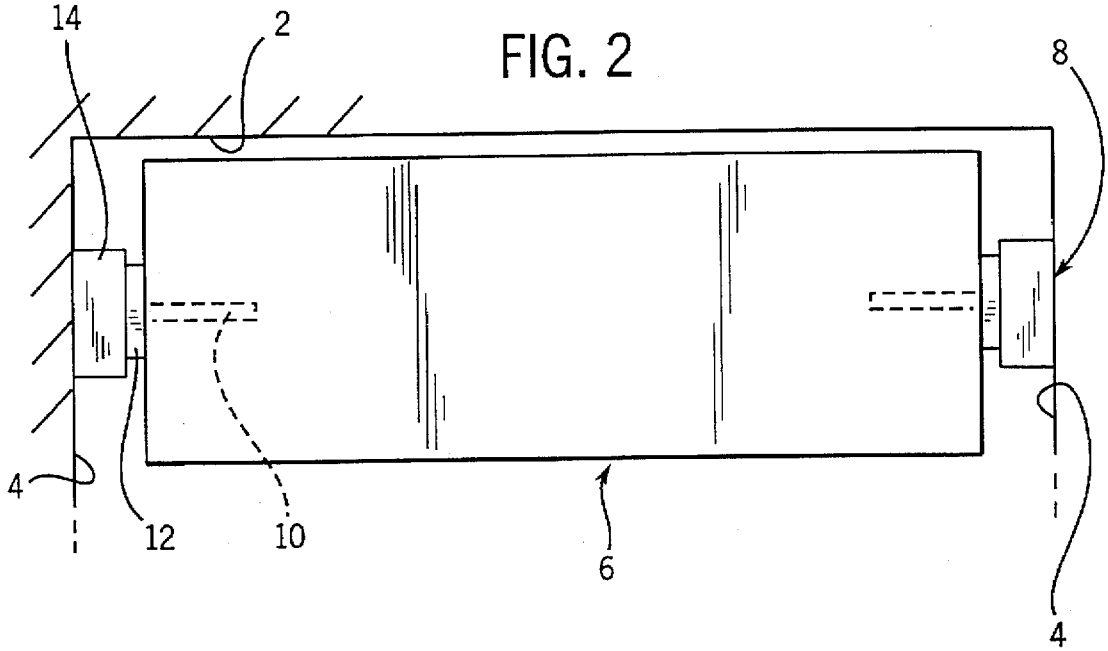
FIG. 2 is a top plan view of the setting apparatus for furniture shown in FIG. 1.
Figure 3:
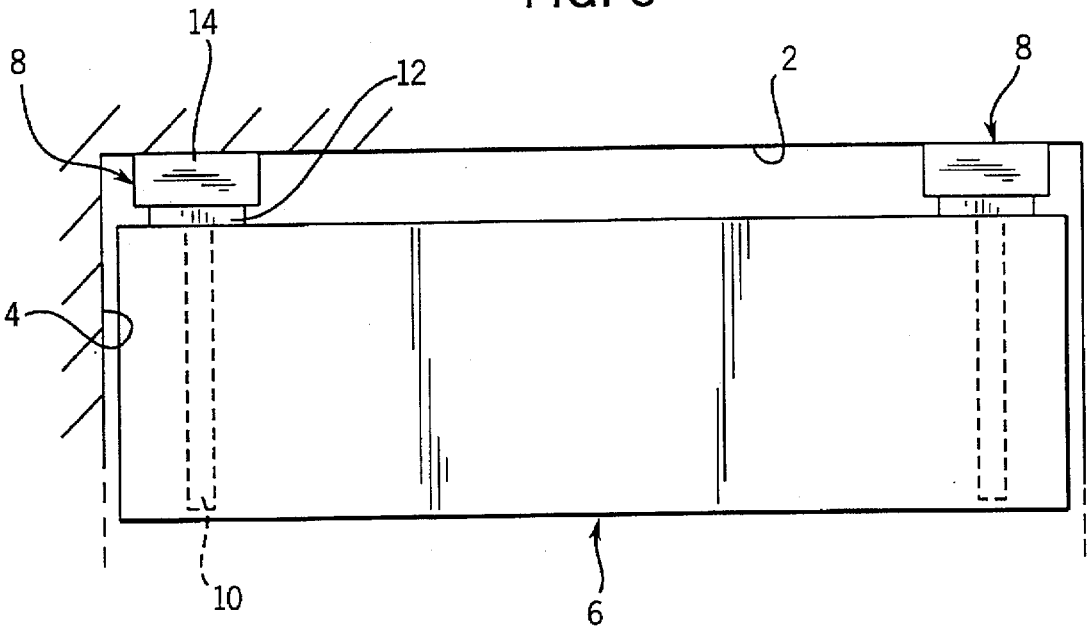
FIG. 3 is a top plan view of another embodiment of the present invention, wherein the setting apparatus for furniture is installed parallel to a side wall.

FIG. 1 shows the apparatus for setting furniture at variable elevations of the present invention, showing the secured furniture in the lowered position in which said furniture may be used. The furniture 6 is secured to the supporting means 10 (also see FIGS. 2 and 3) of the apparatus 8 for setting furniture which is mounted on opposite sides of the wall surfaces. Apparatus 8 for setting furniture may be mounted on the opposite sides of the walls 4 as shown in FIG. 2 or on one side of said wall 2 only, as shown in FIG. 3. The figure shows one apparatus for setting furniture which has been installed but the number and installation position may be varied as desired.

Figure 4:
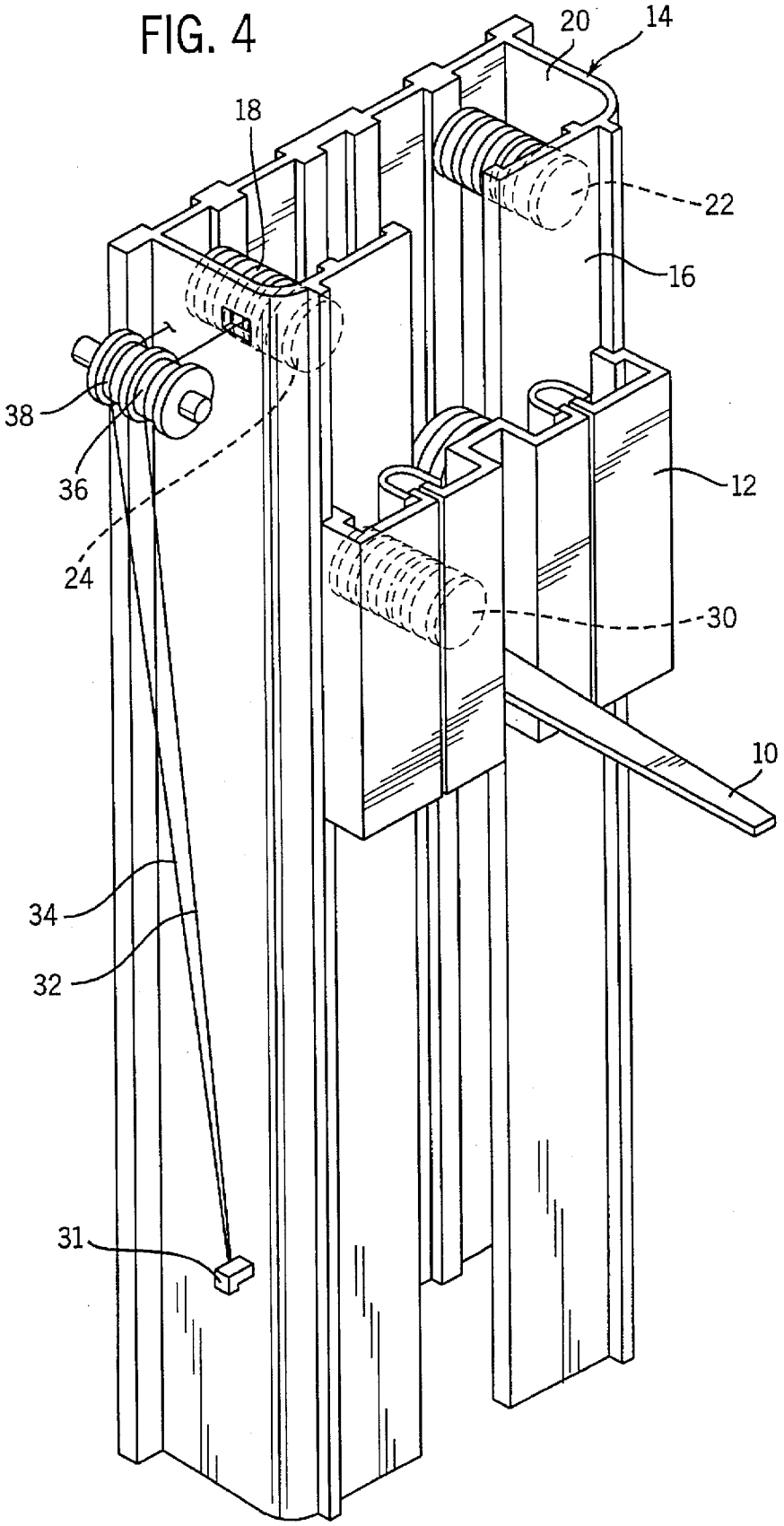
FIG. 4 is a perspective view of the setting apparatus for furniture of the present invention.

FIG. 4 is a perspective view of the apparatus 8 for setting furniture in variable elevating positions. The apparatus for setting furniture is installed on the surface of an interior wall. In this embodiment, the apparatus is comprised of a rail 14 which provides a pair of fixed pulleys 22, 24 respectively on the upper interiors of the rail 14; an elevating means 12 which may be moved along the rail 14 on the rail surface and which provides a movable pulley 30, a guide 44, a roller 46 and a supporting means 10; a outlet pulley 36 which is secured on the upper portion of the rail exterior at the same height as the fixed pulleys 22, 24; a rope 32 which is wrapped around the outlet pulley 36, fixed pulleys 22, 24 and the movable pulley 30.

The cross-section of rail 14 is approximately rectangular and a groove 40 of constant width is provided in the longitudinal direction of the rail 14. Thus, rail 14 is comprised of a rear panel 18 which has secured to its corners fixed pulleys 22, 24; side panels 19 which extend perpendicularly from the rear panel 18 from the two side corners of the rear panel 18; and a front panel 16 which extends between the side panels 19, in a direction parallel to the rear panel 18, and which has a groove 40 extending between the free ends thereof. The guide 44 and the roller 46 of the elevating means 12 is incorporated into grooves 40 and 42, respectively, to guide the vertical motion of the elevating means 12 (see FIG. 5).

One end of rope 32 is secured onto a catch 26 which is attached to the upper portion of the rail 14. The rope 32 is extended through a hole 28 formed in the side panel 19 of the rail and is wound on fixed pulleys 22, 24 and movable pulley 30 in a predetermined way. The other end of the rope 32 is wound on outlet pulley 36 and is drawn out, so that the user may operate the elevating means by pulling or releasing said rope 32. As can be seen from FIG. 4, in the lower portion of the rail 14, it is provided means to bind the end portion of the rope 32, such as a hold post 31. The end portion of the rope 32 can be tied to the hold post 31 by the user, thereby the elevating means 12 can be secured at the desired elevated position.

FIG. 4 shows outlet pulley 36 near the upper end of one side of the rail 14 but its installation position may be varied as appropriate. A rope 34 shown in FIG. 4 is drawn out from another rail (not shown) which is secured to the opposite wall likely to the rail 14. Although it is not depicted in the drawing, the rope 34 is wound around the fixed and the movable pulleys in the same way as the rope 32 and is drawn out from the rail. The rope drawn out from the rail can be wound around the out pulley 38 by way of several support points on the wall (not shown), thereby it can be tied to the hold post 31 along with the rope 32.

Figure 5:
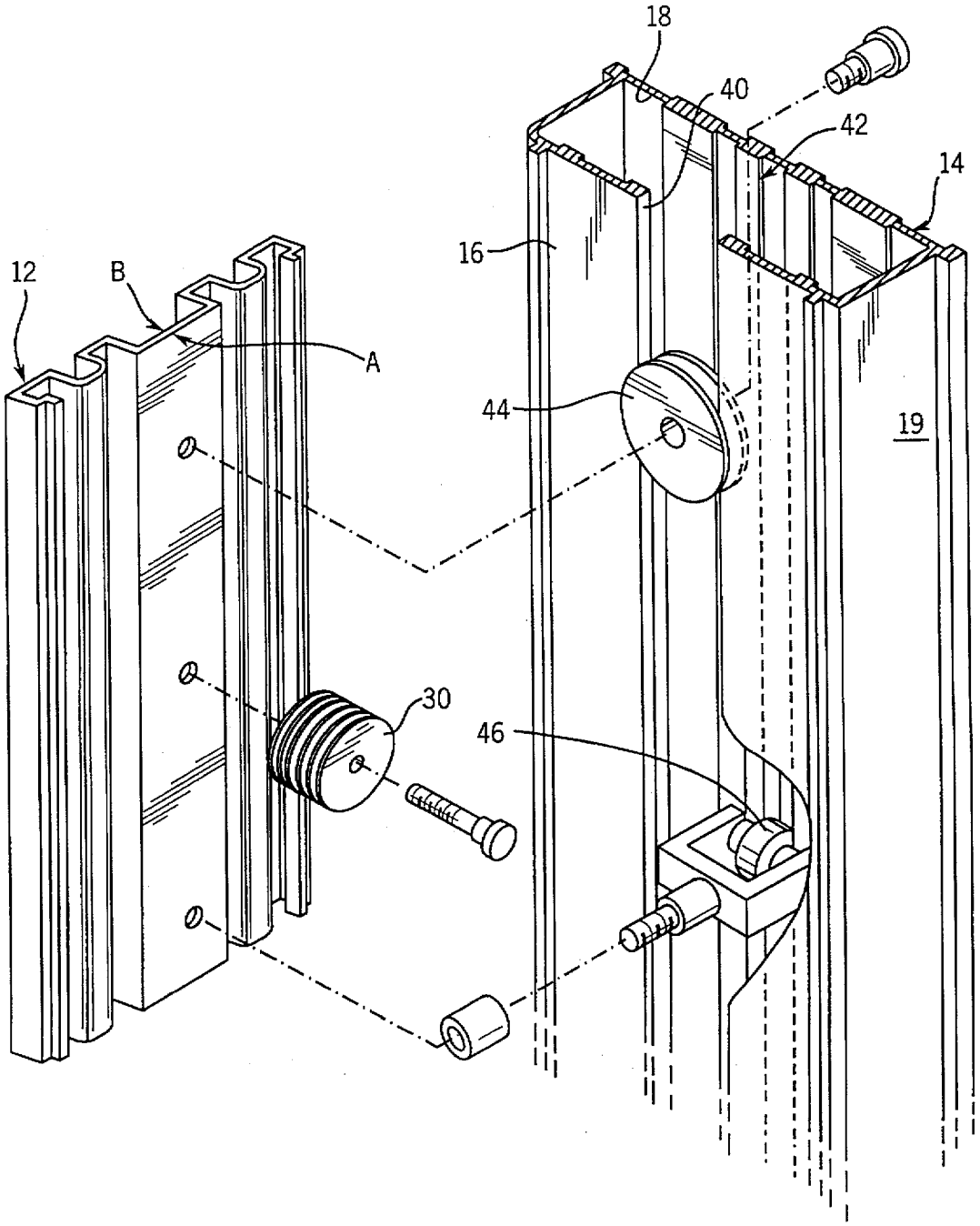
FIG. 5 is an exploded perspective view which shows the connecting relationship between the rail and the elevating means in the setting apparatus for furniture shown in FIG. 4.

FIG. 5 generally illustrates the connection relationship between rail 14 and elevating means 12. As shown in this figure, movable pulley 30 is rotatably secured at about the middle, lengthwise, of the rear side (A) of the elevating means, which faces the front side of the rail. At fixed distances from said movable pulley, the guide 44 and the roller 46 are evenly spaced by means of pins or screws or other appropriate means so that upon the operation of the elevating means 12 by movement of the rope, the elevating means 12 does not lean away from groove 40 of the rail 14 and provides for stable vertical motion.

The guide 44 is inserted into groove 40 between the left and right front panels 16 of rail 14 so as to provide a sliding motion or rotating motion. The roller 46 is inserted into groove 42, which is formed longitudinally in rear panel 18 of rail 14. A supporting means 10 (FIG. 3), which may attach to and provide the vertical movement of furniture, e.g., a desk 6 (FIG. 1), is secured onto the front side (B) of elevating means 12.

Figure 6:
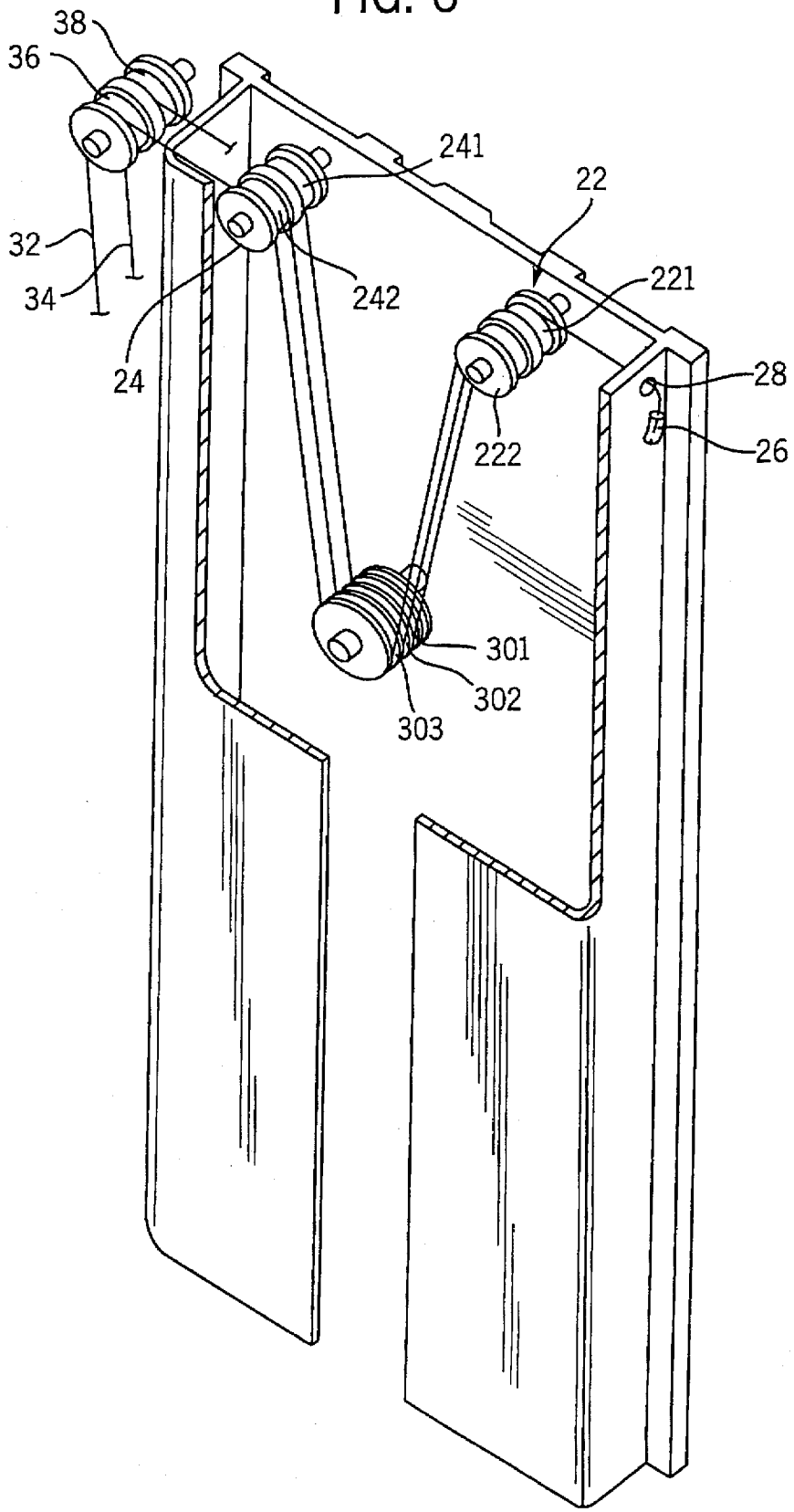
FIG. 6 is a partially broken away perspective view which shows the connecting relationship between the pulley group and the rope in the rail interior of the setting apparatus for furniture shown in FIG. 4.

FIG. 6 shows in detail two fixed pulleys 22, 24 which are secured onto rail 14 and the winding configuration of the rope wound thereon. This figure shows a partially broken away view of the front panel of rail 14 so that the pulley arrangement and the rope winding relationship may be clearly seen. As can be seen from this figure, a rope 32 is wound around fixed pulleys 22, 24, outlet pulley 36 provided on the exterior of rail 14, and movable pulley 30 which is secured to elevating means 12. Consequently, the user may pull or release rope 32 to operate the elevating means 12.

The following explains in greater detail the configuration of rail 14, elevating means 12, and outlet pulley 36; and the process by which to wind and connect the driving rope to this pulley. First and second fixed pulleys 22, 24, which are respectively comprised of two pulleys which are independently rotatable coaxially, are axially mounted on opposite positions at the upper left and right corners on rear panel 18 of rail 14.

Movable pulley 30, installed on the elevating means 12, is comprised of three stacked pulleys. At the rail exterior, close to said second fixed pulley 24, a pulley set 39, which comprises two stacked pulleys 36, 38 which are independently rotatable, is axially mounted. Here, one row (221, 241, 301) of the first, second fixed pulleys and movable pulley (22, 24, 30) are located close to the rear panel of rail 14. One end of rope 32 is secured onto the catch 26 on the upper portion of rail 14. From this starting point, rope 32 is wound in the following sequence. The first fixed pulley, row 1 (221)→movable pulley, row 1 (301)→the second fixed pulley, row 1 (241)→movable pulley, row 2 (302)→the first fixed pulley, row 2 (222)→movable pulley, row 3 (303) →the second fixed pulley, row 2 (242). At this point, the remainder of the rope is drawn out over the outlet pulley 36 attached to the exterior of the rail. Similarly, the free end of the rope 34 wound on the respective pulleys of another rail secured to opposite interior wall, is drawn out over the outlet pulley 38. Finally, portions of the driving rope 32, 34, drawn out as described above, are secured by appropriate means such as a hold post 31, to the pre-set position of the lower part of rail 14.

Figure 7:
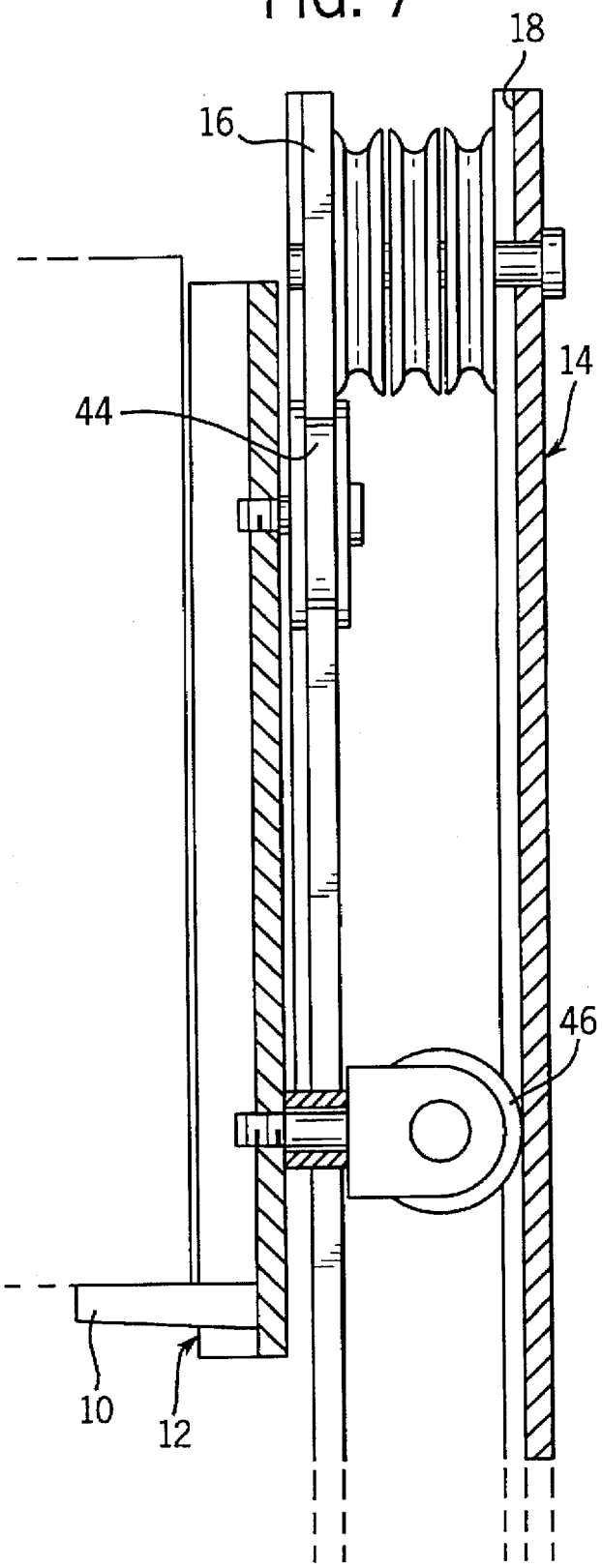
FIG. 7 is a side elevation which shows the connecting relationship between the rail and elevating means, as shown in FIG. 5, through the guides.

FIG. 7 is a sectional view which shows rail 14 and elevating means 12 in interfaced relation with one another. As shown in detail in this figure, the guide 44 and the roller 46 are respectively secured onto the rear side of elevating means 12 by appropriate means, such as by screws, etc. From above, the guide 44 is slidably mounted in groove 40 between the left and right front panels 16 of rail 14, and the roller 46 is resides in groove 42 (FIG. 8) formed on rear panel 18. By the means described above, the guide 44 maintains elevating means 12 in contact with the rail 14 at rest and during vertical motion, and the roller 46 prevents the elevating means from rotating to the front or back about the pivot point of guide 44 upon the load resulting from the furniture being placed upon the supporting means 10. Further, the guide 46 prevents the horizontal displacement of the elevating means upon the furniture's vertical motion, as it is inserted into the groove 42 formed in the front of the rear panel of rail 14, and thus provides for stable vertical motion.

Figure 8:
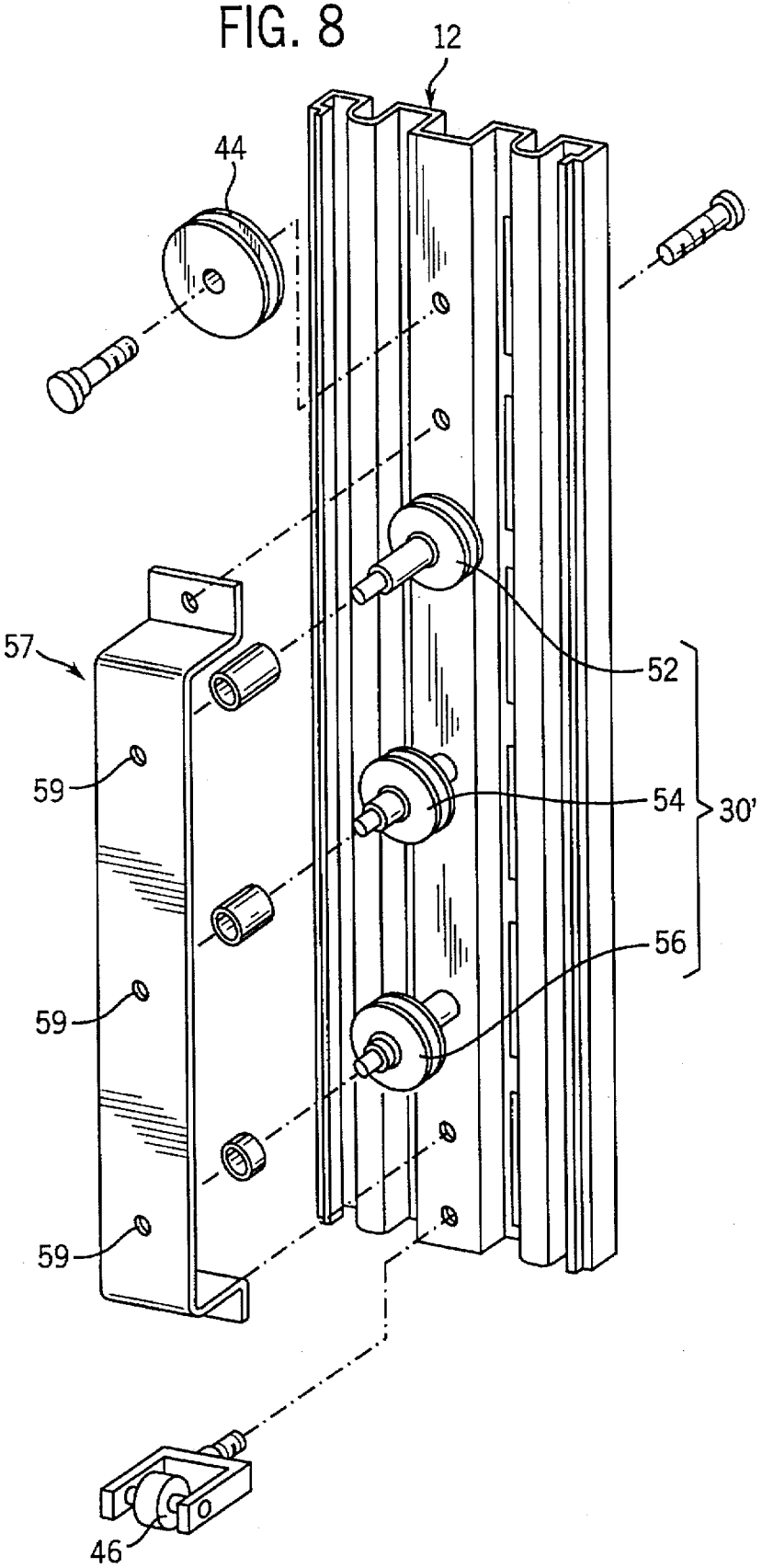
FIG. 8 is an exploded perspective view which shows another embodiment of the elevating means of the present invention.

FIG. 8 is an explored perspective view which shows elevating means 12 with another arrangement for the movable pulley 30'. The movable pulley 30' of this embodiment, unlike the embodiments described above, instead of mounting three stacked pulleys, one pulley each (52, 54, 56) is securely mounted at three different longitudinal displacements from the lengthwise direction of the elevating means. A supporting bracket 57, which is formed by outwardly bending both ends of a metallic piece of constant width and length, and which has holes 59 formed at positions corresponding to each pulley (52, 54, 56), is provided so that the displacement of said pulleys (52, 54, 56) from the rear side of the elevating means 12 may be separately fixed.

For the embodiment using movable pulley 30' as described above, if the rope 32, 34 is pulled to elevate furniture 6, this force is transmitted through the two fixed pulleys 22, 24 to movable pulley 30', and said elevating means 12 is elevated by the guide 44 and the roller 46 and thus, furniture 6 is elevated. Said movable pulley 30' is mounted in a configuration where each pulley is spaced vertically at intervals along supporting bracket 57 and lie in different horizontally spaced planes. Each pulley is thus are independently rotatable. Thus, the tension applied to the rope 32, 34 by the user to operate elevating means 12 is evenly distributed among the three locations at which the pulleys (52, 54, 56) are mounted. This prevents undesired movement of the supporting means or the deformation of the shaft of movable pulley 30 where the pulleys are stacked and installed at one location and where as a consequence, all the force is concentrated at one point. Thus, this has the effect of increasing the performance and reliability of the product by providing for better operation of the apparatus.

Figure 9A:
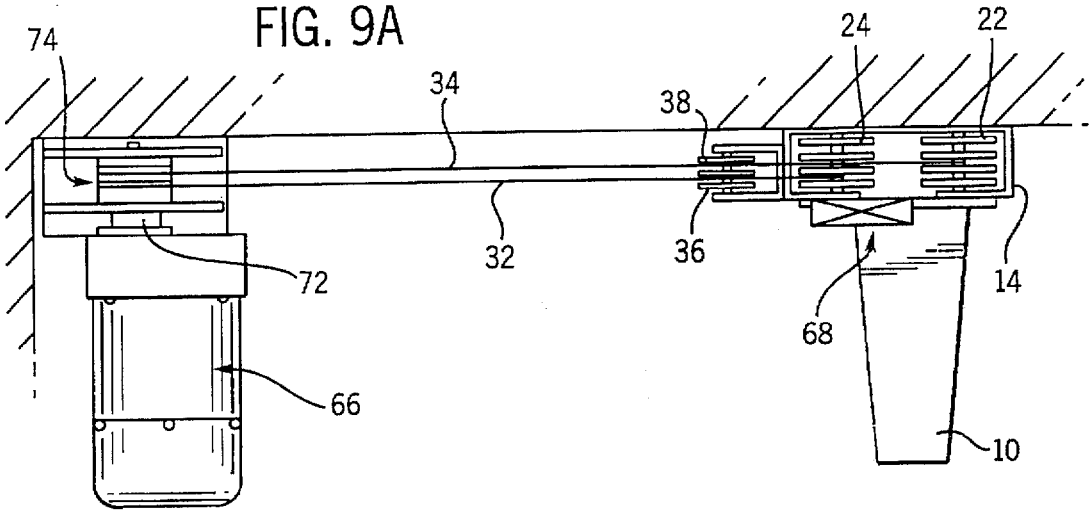
FIGS. 9A and 9B are schematic illustration views of the mounting scheme for the drive mechanism used to effect the vertical motion of the apparatus for setting furniture of the present invention.
Figure 9B:
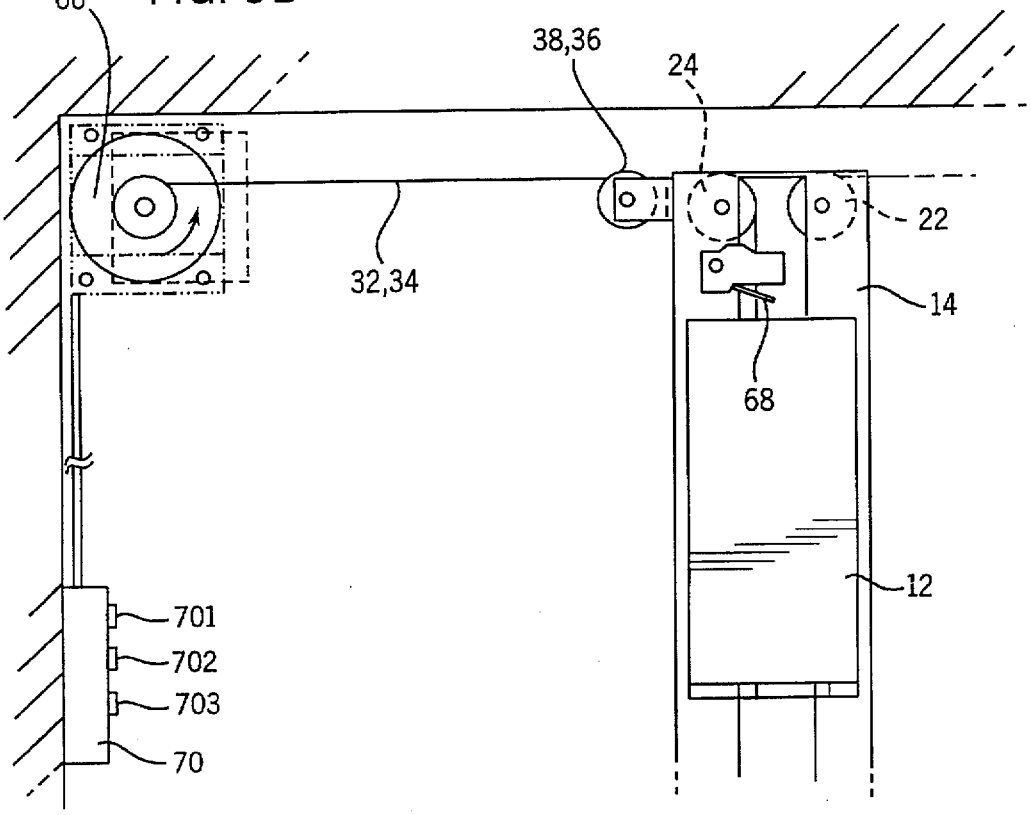

Another method of using the rope to operate the setting apparatus for furniture of the present invention uses a drive mechanism operated by an electric motor 66, as shown in FIGS. 9A and 9B. The drive mechanism includes multiple fixed pulleys 22, 24 mounted on rail 14; multiple movable pulleys 30 mounted on elevating means 12; outlet pulleys 36 and 38 secured onto the exterior of rail 14; and rope 32 and 34 which is connected to these pulleys, and a portion of the rope which is extended outside of said fixed pulleys, so that when this exposed portion is wound around or unwound from the drum 74, said elevating means 12 will be raised or lowered. A sensing means, such as limit switch 68, which limits the vertical motion of elevating means 12 within a defined range, may be included.

Figure 10A:
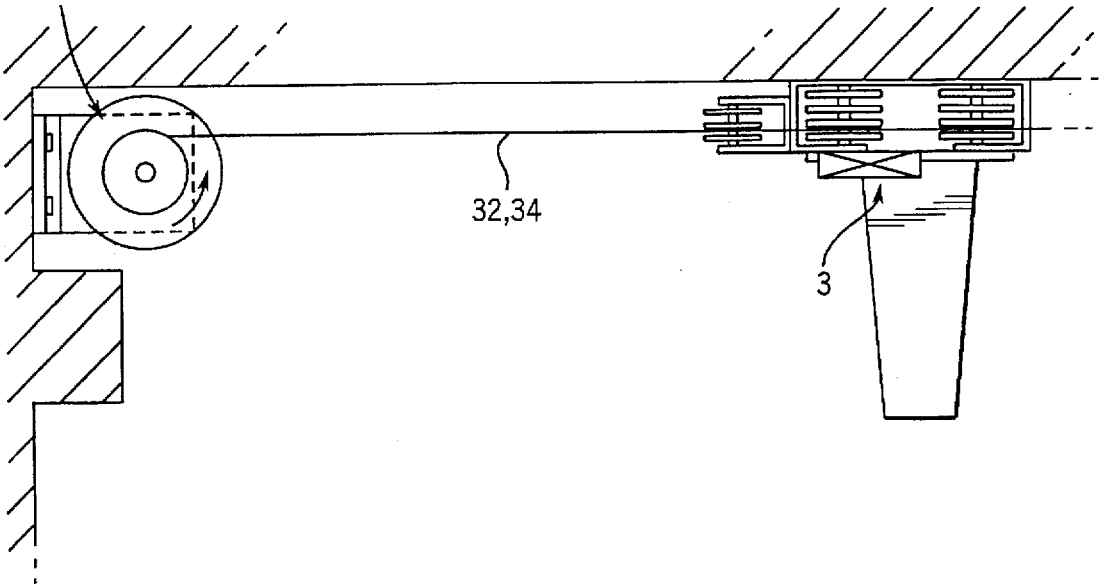
FIG. 10A and 10B are schematic illustration views of another embodiment of the driving mechanism.
Figure 10B:
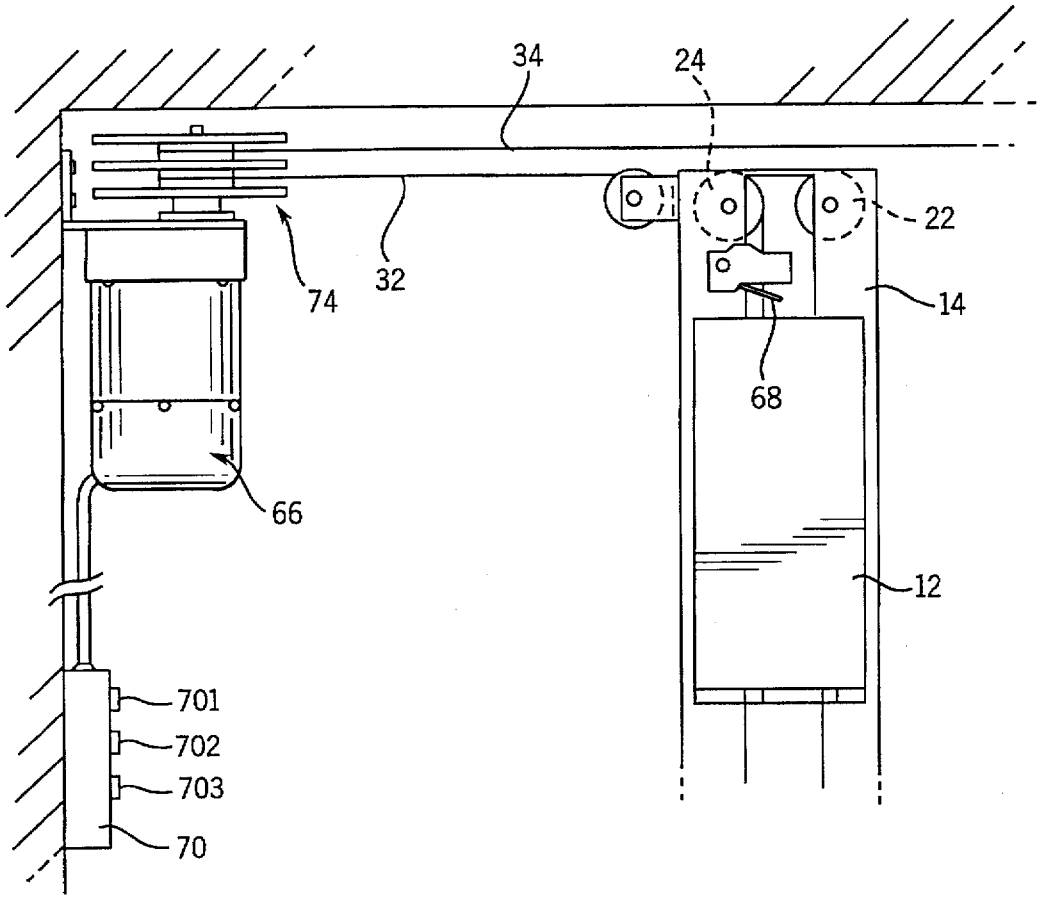

FIGS. 10A and 10B show another embodiment of the driving mechanism. This embodiment shows where, due to the difficulty in installing the driving mechanism on the same wall surface where the rail has been installed, the driving mechanism has been installed on the wall surface perpendicular to the wall surface where the rail was installed. In this embodiment, drums 74 are comprised of two members, the height of two rails 14 installed on the wall surface are varied, and the outlet pulleys 36 and 38 are also mounted at different heights, so that rope 32 and 34 do not tangle.

According to the embodiments shown in FIGS. 9 and 10, an actuating switch device 70 for the apparatus for setting furniture in variable elevating positions of the present invention provides a forward button 701, a reverse button 702 and a stop button 703. Upon pressing the forward or reverse rotation button, drum 74 mounted at the rotation axis 72 rotates, thus drawing or unwinding rope 32 and 34 from the drum 74, thus operating the elevating means and varying the vertical position of the furniture secured onto the elevating means as desired.

The vertical motion of the furniture may be appropriately controlled by using a sensing device such as one or more limit switches, which are known in the art. For example, once the furniture, upon elevation, touches the contact point formed upon sensing means 68, sensing means 68 sends an operation control signal to electric motor 66, with this operation control signal activating the braking pad within electric motor 66 and disengaging the electric current. Thus, the vertical motion of the furniture may be limited within a defined range. Although it is not shown in the drawings, a sensing device may also be used to limit the lowered position of the furniture.

Upon using the apparatus for setting furniture in variable elevated positions of the present invention, furniture may be lowered to the desired position for use. When the furniture is not in use, it may be elevated to a pre-set height towards the ceiling, so as to provide access to a greater portion of the interior floor space, and more effectively use a small interior area.

While particular embodiments of the invention have been shown and described in detail, it will be obvious to those skilled in the art that changes and modifications of the present invention may be made without departing from the invention. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

What is claimed is:

1. An apparatus for setting furniture in variable elevating positions comprised of:

(a) a rail (14) which is vertically secured onto the surface of an interior wall;

(b) elevating means (12) which vertically move upon and along said rail (14) and include a furniture supporting means (10) and a guide means for preventing rotation of said elevating means; and (c) driving means to effect the vertical motion of said elevating means (12), said driving means is composed of:

a) one or more fixed pulleys (22, 24) mounted on said rail (14), b) one movable pulley assembly (30) mounted on said elevating means (12), c) an outlet pulley (36, 38) secured onto the exterior of said rail (14), and d) a rope (32, 34) connected to said pulleys and pulley assembly so if a portion of the rope extended from said outlet pulley (36, 38) is pulled, said elevating means (12) will be elevated in vertical position, and if said exposed portion of the rope is released, said elevating means (12) will be lowered in vertical position;

wherein said guide means has at least one guide (44) slidably fit to said rail and a roller (46) longitudinally spaced from said guide (44) and rolling in a groove (42) of said rail, and wherein said movable pulley assembly (30) is mounted onto the rear side of said elevating means (12) and is comprised of a plurality of independently rotatable unit pulleys.

2. The apparatus of claim 1, wherein said movable pulley assembly (30) is comprised of two coaxially stacked independently rotatable unit pulleys.

3. The apparatus of claim 1, wherein said movable pulley assembly (30) is comprised of three coaxially stacked independently rotatable unit pulleys.

4. The apparatus of claim 1, wherein said movable pulley assembly (30) is comprised of four coaxially stacked independently rotatable unit pulleys.

5. The apparatus of claim 1, wherein said unit pulleys (52, 54 or 56) of the movable pulley assembly are all located at different heights from the rear side of said elevating means (12).

6. The apparatus of claim 1, wherein said driving means additionally includes an electric motor (66) and a drum (74) secured at the rotating shaft of said electric motor, and said portion of said rope is secured onto said drum.

7. The apparatus of claim 6, wherein a sensing device (68) is provided, which senses the position of said elevating means (12) so that once said elevating means reaches a pre-set position, said sensing device sends a signal to said electric motor (66), stopping the rotation of said electric motor.

8. The apparatus of claim 1, wherein the cross section of said rail (14) is rectangular and wherein said rail has a groove (40) formed thereon in the lengthwise direction over the length of said rail.

9. The apparatus of claim 1, wherein said at least one guide means slidably fits to said rail groove (40) and provides guidance and support for the vertical motion of said elevating means (12).

* * * * *